United States Patent [19]

Hirose

[11] Patent Number: 4,492,173

[45] Date of Patent: Jan. 8, 1985

[54] DETACHABLE PRESSURE FOOT WITH SOLENOID ACTUATED SECURING DEVICE

[75] Inventor: Tomonao Hirose, Tokyo, Japan

[73] Assignee: Kohshin Seimitsu Kikai Kabushiki Gaisha, Tokyo, Japan

[21] Appl. No.: 524,159

[22] Filed: Aug. 18, 1983

[30] Foreign Application Priority Data

Aug. 23, 1982 [JP] Japan ..... 57-127586

[51] Int. Cl.[3] ..... D05B 29/06

[52] U.S. Cl. ..... 112/240

[58] Field of Search ..... 112/240

[56] References Cited

U.S. PATENT DOCUMENTS 3,326,160 6/1967 Murino ..... 112/240

3,489,114 1/1970 Seck ..... 112/240

4,385,576 5/1983 Marsh ..... 112/240

*Primary Examiner*—Werner H. Schroeder

*Assistant Examiner*—Andrew M. Falik

*Attorney, Agent, or Firm*—Birch, Stewart, Kolasch & Birch

[57] ABSTRACT

A detachable pressure foot mount to be used in a sewing machine which comprises a hollow solenoid fixed to a holder, which in turn is fixed to a sewing machine push rod, a spring biased drive rod slidingly fitted in a hollow space of the solenoid, and a hold pin connected to the rising end of the drive rod via a joint, and extending to a recess made in the bottom of the holder, to catch a cross rod of the pressure foot when the cross rod fits in the recess in the bottom of the holder.

3 Claims, 7 Drawing Figures

DETACHABLE PRESSURE FOOT WITH SOLENOID ACTUATED SECURING DEVICE

BACKGROUND OF THE INVENTION

Field of the Invention

This invention relates to an improvement in a cloth pushing unit of a sewing machine, and more specifically to an improvement of a pressure foot mount of the cloth pushing unit.

A pressure foot for pushing and holding a piece of cloth against the base plate of a sewing machine is detachably mounted to a holder attached to the lower end of a push rod, and different pressure feet are selectively used for pushing and holding different kinds of cloth.

Description of the Prior Art

A conventional cloth pushing unit structure is represented in FIG. 6. As shown, an operating lever "1" is rotatably fixed to the rear part of a holder "h", and is spring-biased toward the inclined position as shown with solid line. A hold pin "p" is fixed to the free end of the operating lever. The hold pin "p" catches the cross rod "t" of a pressure foot "k" when the hold pin "p" is extended, as shown in FIG. 6. When the operating lever "1" is pushed and rotated about its pivot by a user's finger to the upright position as shown by the phantom line, the hold pin "p" is withdrawn until the pressure foot is released.

FIG. 7 shows another conventional cloth pushing unit structure having an operating lever molded of a resilient synthetic resin, thus eliminating the necessity of using a spring "b" to bias the operating lever towards an inclined position. In operation, the operating lever "1" is pushed by a user's finger against its resilience, thereby withdrawing an associated hold pin "p" until a presser foot "k" is released from the holder "h".

In either case, however, the operating lever "1" is behind the holder "h", and therefore if it is desired to withdraw the hold pin "p" to release the pressure foot "k", a person has to feel for the operating lever "1" behind the holder "h". This is an inconvenience to the person. What is worse is that the operating lever is likely to be tangled with thread when the worker tries to cut the thread. Thus, the worker can inadvertently touch the operating lever and release the pressure foot, undesirably, while trying to untangle the thread.

SUMMARY OF THE INVENTION

The object of this invention is to provide a cloth pushing unit using a solenoid-actuated pin holder in place of an operating lever, thereby eliminating the above mentioned disadvantages.

To attain this object a detachable pressure foot mount according to the present invention comprises a hollow solenoid fixed to a holder which, in turn, is fixed to a push rod in a sewing machine. A drive rod is slidingly fitted in the hollow space of the solenoid and spring-biased so as to appear partly above the hollow solenoid. A hold pin is connected to the rising end of the drive rod via a crank-like joint, extending as far as necessary to close a recess provided in the bottom of the holder, thereby catching a cross rod of a pressure foot when the cross rod is fitted in the recess in the bottom of the holder. In operation, the solenoid is energized to withdraw the drive rod, and hence the hold pin, until the cross rod of the pressure foot is released.

BRIEF DESCRIPTION OF THE DRAWINGS

Other objects and advantages of this invention will be understood from the description of a preferred embodiment according to this invention, which description is made with reference to accompanying drawings.

DESCRIPTION OF THE PREFERRED EMBODIMENT

Figure 1:
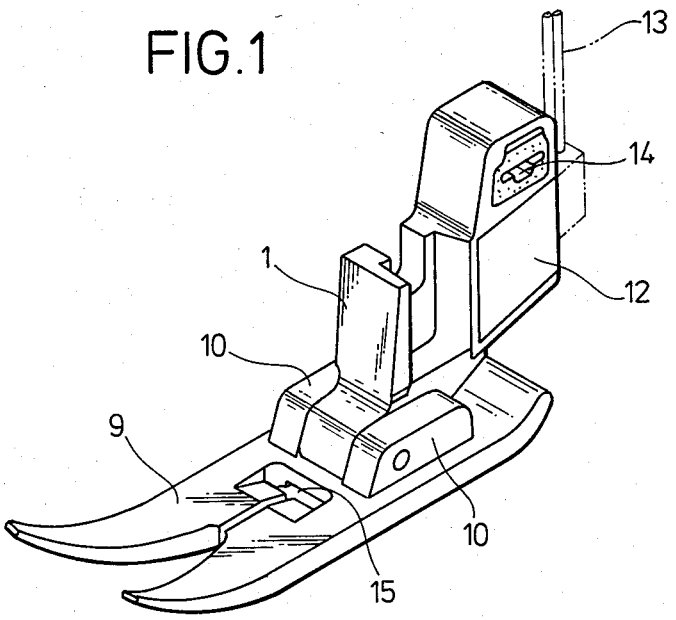
FIG. 1 is a perspective view of a cloth pushing unit of a sewing machine according to an embodiment of this invention.

Referring to FIGS. 1 to 4, a holder 1 is designed to mount to the lower end of a push rod (not shown) in a sewing machine. A hollow solenoid 2 is fixed to the rear side of the holder 1. A joint in the form of a crank 4 is fixed at one end to a drive rod 3, which is slidingly fitted in the hollow space of the solenoid 2. The crank-shaped joint 4 is fixed at the remaining end to a hold pin 5, which extends parallel with the drive rod 3 in the solenoid 2.

Figure 3:
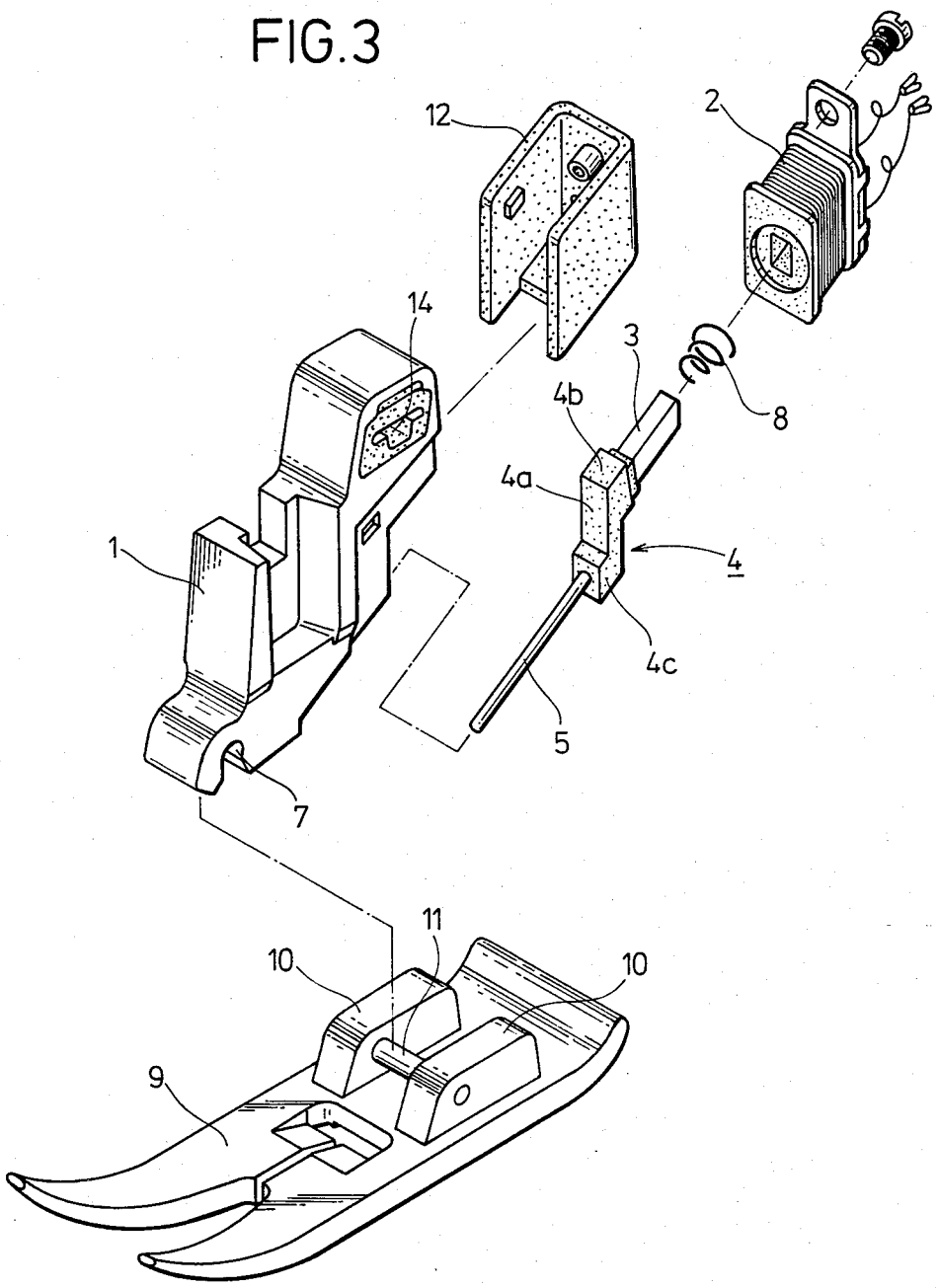
FIG. 3 is an exploded view of the cloth pushing unit.

The crank-like joint 4 is composed of a non-magnetic, synthetic resin material, and as is best shown in FIG. 3, its intermediate part 4*a* is much thinner than its opposite ends 4*b* and 4*c*, thereby permitting the crank-like joint 4 to bend when it is subject to an external force.

Figure 2:
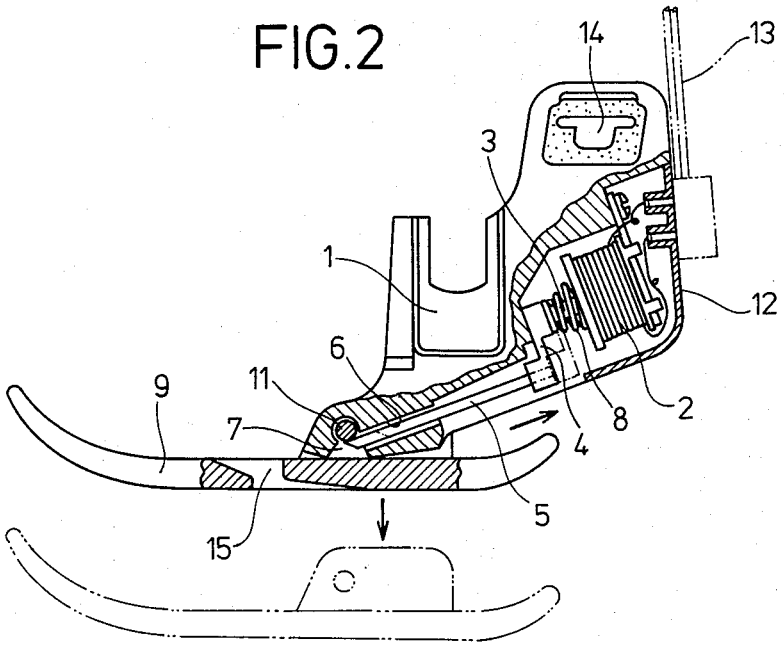
FIG. 2 is a side view of the cloth pushing unit, partly in section.
Figure 4:
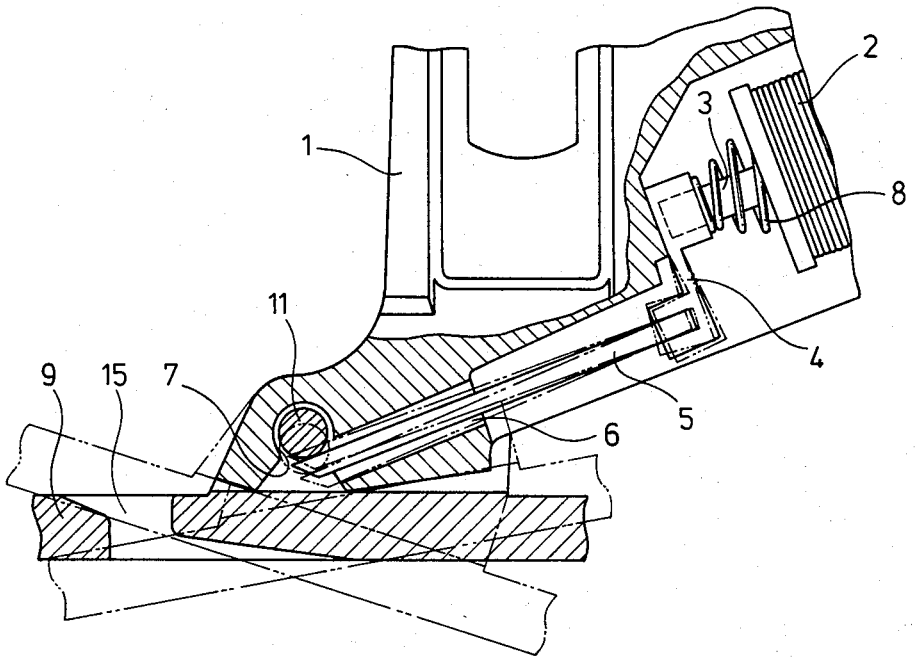
FIG. 4 is an enlarged side view of a part of the cloth pushing unit, partly in section.

The hold pin 5 is slidingly inserted in a guide hole 6, which is made in the holder 1. As shown in FIGS. 2 and 4, the end of the holder pin 5 advances somewhat ahead of the intermediate point between the opposite edges of the loophole of a recess 7, which is made in the bottom of the holder 1. The guide hole 6 has an inner diameter larger than the diameter of the hold pin 5, thereby leaving a clearance between the guide hole 6 and the hold pin 5.

A coiled spring 8 is located between the crank-like joint 4 and the solenoid 2, thereby pushing the joint 4 against the holder 1 all the time. In this spring-biased and extending position the hold pin 5 projects into the recessed portion of the bottom of the holder, reaching short of the opposite edge of the recess 7.

The pressure foot 9 has two opposite uprights 10 and a cross rod 11 extending therebetween.

When mounting the pressure foot 9 to the holder 1, first, the pressure foot 9 is put on a needle plate (not shown), and then the holder 1 is lowered onto the pressure foot 9, allowing its cross rod 11 to push the hold pin 5 backward against the resilient force exerted by the coiled spring 8 until the cross rod 11 of the pressure foot 9 fits in the recess 7 of the bottom of the holder 1. Then, the hold pin 5 returns to the initial spring-biased and extending position under the resilient influence of the coiled spring 8, thus projecting the tip of the hold pin 5 under the cross rod of the pressure foot 9 to catch the pressure foot 9.

The bottom of the holder 1 is chamferred to incline upward forward an rearward with respect to the recess 7 of the bottom of the holder, thereby leaving a wedge-like space between the holder bottom and the pressure foot 9 so as to enable the pressure foot 9 to swivel about its cross rod 11, as shown with phantom line in FIG. 4.

The hollow solenoid 2 is contained in a casing 12, through which an electric cord 13 from the solenoid 2 extends. In a hole 14 a stitch rod is to be fitted, and the pressure foot 9 has a needle slit 15.

Figure 5:
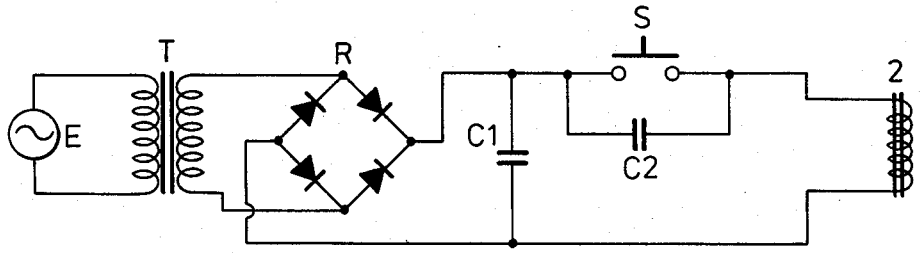
FIG. 5 shows a wiring diagram of a solenoid and other associated electrical circuit elements for withdrawing a hold pin in the pressure foot mount to release an associated pressure foot.
Figure 6:
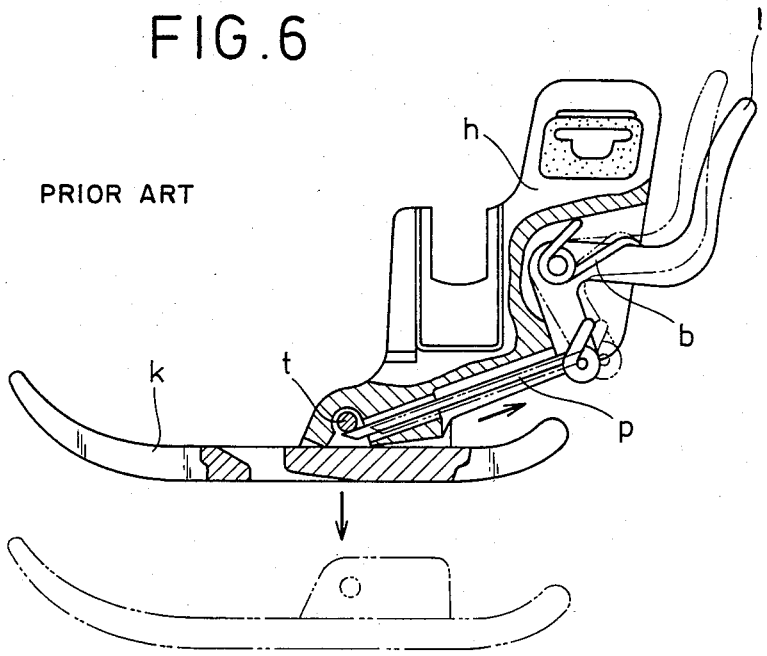
FIG. 6 PRIOR ART
FIG. 6 shows a side view of a conventional cloth pushing unit, partly in section.
Figure 7:
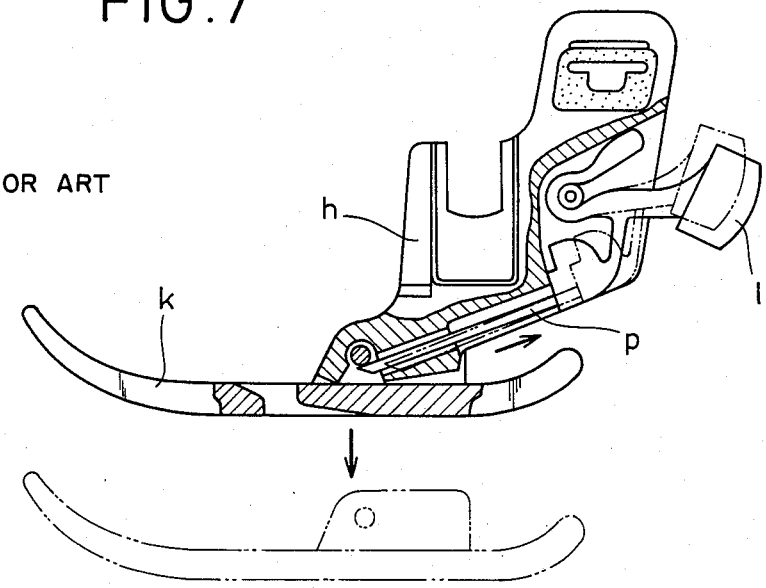
FIG. 7 PRIOR ART
FIG. 7 shows a side view of another conventional cloth pushing unit, partly in section.

The hollow solenoid 2 is connected to a power supply "E" via a switch "S", which is advantageously positioned in the front panel of the sewing machine (See FIG. 5).

As shown in FIG. 5, an electric transformer "T" is connected across a power supply "E", and a full-wave rectifier bridge "R" is connected across the transformer "T". A smoothing capacitor "$C_1$" is connected across the rectifier bridge "R". A capacitor "$C_2$" is connected across the switch "S" to prevent an electric arc from appearing across the switch "S" when turned off.

In operation, the push rod (not shown), is raised to lift the pressure foot 9, and then the switch "S" is turned "ON" to energize the hollow solenoid 2, thus withdrawing the hold pin 3 against the resilient force of the coiled spring 8 until the hold pin is cleared from the loophole of the recess. Then, the pressure foot 9 is released from the holder 1 to fall down. When the switch "S" is turned off to deenergize the solenoid 2, the hold pin 5, spring-biased towards the initial closed position, returns to this position. Then, the holder 1 is lowered on another pressure foot 9, allowing its cross rod 11 to invade the recess 7 of the bottom of the holder while the hold pin 5 is yieldingly withdrawn. When the cross rod 11 of the new pressure foot fits in the recess of the bottom of the holder, the hold pin 5 returns to the initial closed position, thereby catching the cross rod 11 of the pressure foot to hold the same.

The pressure foot 9 attached to the holder 1 is adapted to push cloth against the base plate, swinging about the forward or rearward edge of the loophole of the recess 7. While the pressure foot 9 swings, its cross rod 11 is somewhat lowered, as seen from FIG. 4. When the pressure foot 9 is raised above cloth, the pressure foot 9 is prevented from descending because the thin intermediate part 4*a* of the crank-like joint 4 applies a resilient force to raise the cross rod 11, and then the pressure foot 9 is brought in contact with the opposite edges of the loophole of the recess, thereby putting the pressure foot 9 in the horizontal position. Therefore, the rise of the pressure foot 9 will not cause a needle to strike against the cross edge of the needle slit 15, thus, preventing the bending or breaking of the needle.

The crank-like joint 4 is made of a non-magnetic material, and therefore it intercepts the magnetic flux from the solenoid 2, thus preventing the magnetic flux from reaching the cross rod 11 via the hold pin 5. Therefore, when the hollow solenoid 2 is energized to withdraw the hold pin 5, the cross rod 11 of the pressure foot 9 is not magnetized, and therefore the pressure foot 9 is not magnetically attracted to the holder 1, thus assuring that the pressure foot falls from the holder 1 when the solenoid is energized.

In brief, in a cloth pushing unit according to this invention, a holder 1 contains a hollow solenoid 2 equipped with a sliding drive rod 3, to which a hold pin 5 is fixed. The hold pin 5 is spring-biased towards the recessed portion of the bottom of the holder to close the loophole of the recess 7. The hold pin 5, also, is responsive to energization of the solenoid for withdrawing and opening the loophole of the recess 7. Thus, a pressure foot 9 is detachably mounted to the holder 1. A switch "S" for operating the solenoid 2 is advantageously positioned in the front panel of a sewing machine, thereby enabling the changing of the pressure foot simply by depressing the switch "S". With the solenoid-actuated arrangement the inconvenience of extending a hand around behind the holder and feeling for an operating lever "1" is eliminated, and thus is no fear there of causing the pressure foot to drop off by inadvertently touching the operating lever behind the holder out of sight. Also, there is no trouble of tangling thread with the operating lever when cutting the thread. The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A detachable pressure foot mount in a sewing machine comprising: a hollow solenoid (2) fixed to a holder (1), which is, in turn, fixed to a push rod in a sewing machine; a drive rod (3) slidingly fitted in the hollow space of the solenoid and spring-biased to rise partly out of the hollow space of the solenoid; and a hold pin (5) connected to the rising end of the drive rod via a joint, and extending to a recess (7) made in the bottom of the holder, thereby catching a cross rod (11) of the pressure foot when the cross rod fits in the recess in the bottom of the holder.

2. A pressure foot mount in a sewing machine according to claim 1 wherein said joint (4) is in the form of a crank, the opposite thick ends of which are connected to said drive rod (3) and said hold pin (5).

3. A pressure foot mount in a sewing machine according to claim 2 wherein said joint is made of a non-magnetic material.

* * * * *